109-49.5
6/2/87 XR 4,669,239

United States Patent [19]

Maggs et al.

[11] Patent Number: 4,669,239

[45] Date of Patent: Jun. 2, 1987

[54] SECURITY BARS AND BARRIER GRIDS INCORPORATING SAME

[75] Inventors: Lou M. Maggs, Dayton; Walter B. Bauer, Springfield, both of Ohio

[73] Assignee: The William Bayley Company, Springfield, Ohio

[21] Appl. No.: 828,457

[22] Filed: Feb. 12, 1986

[51] Int. Cl.[4] ..... E04H 3/08

[52] U.S. Cl. ..... 52/106; 52/725; 109/49.5

[58] Field of Search ..... 52/106, 507, 722, 725, 52/727, 730, 731; 109/49.5, 10; 49/15, 50; 428/384

[56] References Cited

U.S. PATENT DOCUMENTS

| | | | |
|---|---|---|---|
| 90,219 | 5/1869 | Baker | 52/106 X |
| 207,476 | 8/1878 | Baker | 52/106 X |
| 2,156,579 | 10/1938 | Bayon | 52/106 X |

FOREIGN PATENT DOCUMENTS

| | | | |
|---|---|---|---|
| 262863 | 10/1965 | Austria | 52/725 |
| 2105596 | 8/1972 | Fed. Rep. of Germany | 52/106 |
| 686128 | 7/1930 | France | 52/725 |

*Primary Examiner*—Carl D. Friedman
*Assistant Examiner*—Naoko N. Slack
*Attorney, Agent, or Firm*—Kinney & Schenk

[57] ABSTRACT

A barrier grid, in the form of a detention window, as employed in jail cells, or the like, is described. It is characterized by security bars which comprise and outer tube and a central core member extending lengthwise thereof. The tubes of the bars are secured to the window's frame. The central core member comprises a structural rod, rotatably mounted on a structural portion of the window frame. Each core member also includes a plurality of ceramic tubular elements which serve to dull a saw where the outer tube has been cut through in an escape. The ceramic elements are encased within a plastic sheath which serves to preserve the structural integrity of the ceramic elements.

11 Claims, 10 Drawing Figures

SECURITY BARS AND BARRIER GRIDS INCORPORATING SAME

The present invention relates to improvements in security bars and barrier grids employed to prevent egress or ingress relative to a secured area, as is most familiarly exemplified in a penal environment.

The present invention is motivated by the need for greater security in the detention of persons in the criminal justice system, particularly focused on the window openings found in jail cells. Practically from the beginning of the use of cells to detain criminals, escape through window openings has been prevented through the use of a metallic grid which has sufficient openwork to admit light and, at times, provide a limited view of the outside world. Most commonly this grid has comprised spaced bars, which are an identifying characteristic of such detention cells. These barred windows are often referenced as detention windows and may also be glazed and provided with screening.

The use of such barrier or security grids, particularly in a prison environment has been a challenge to the criminal mind. Metal cutting saws, smuggled to prisoners, or employed by accomplices from the outside, frequently enable escape, by cutting the bars of the grid.

Over the years, many proposals have been made and adopted to increase the security of detention windows. Among these improvements, the availability of harder, carbon, alloy steels for the fabrication of the security bars has been most effective. Such steels are resistant, if not immune, to being cut by ordinary steel cutting saws, commonly referenced as "hack saws".

Further security has been provided by loosely mounting the bars in a framework and then encasing them in tubes which are secured to the framework. Thus, even though it may be possible to cut through the outer tube, when the saw engages the loosely mounted bar, it will tend to rotate relative to the frame, rather than being cut by the saw. The outer tube prevents the inner, security bar from being manually held against rotation, which would enable the saw to effect a cutting action.

Notwithstanding the apparent effectiveness of these improvements in security bars and detention windows, the relatively recent introduction of carbide cutting tools has enabled their purpose to be avoided. For purposes of cutting bars, or the like, such cutting tools generally take the form of a relatively small diameter wire, thin ribbon, to which are bonded tungsten carbide particles. These carbide saws are more readily concealed than conventional hack saws, making it easier to avoid detection in being placed in the hands of a prisoner. More importantly, they are capable of cutting hardened steel, security bars, even when encased in a protective tube.

While reference has been made to the problems of maintaining security in detention windows, similar problems are encountered in other environments. Security bars are also be employed to define the perimeter of a cell, and its door. Likewise, barrier grids incorporating such bars are commonly used to block air ducts and other passageways through which an escape might otherwise be made. Further, security bars may be employed to prevent unwanted intrusion as well as unauthorized egress, as in an escape.

Accordingly the object of the invention is to provide an improved security bar which is significantly more difficult, if not impossible, to sever with cutting tools now available.

A further object of the invention is to provide an improved barrier grid incorporating security bars which minimize the possibility of the bars being severed and thus enhance the security provided by the grid.

These ends are broadly attained by a security bar comprising an outer tube and a central, core member, extending lengthwise within the tube. The core member comprises a structural rod and protective means surrounding the rod.

The protective means may be a ceramic material fabrication. Should the outer tube be severed, the ceramic material will dull and render a carbide saw ineffective to cut and breach the security provided by the structural rod. The ceramic protective means may take the form of tubular elements telescoped over the rod and encased within a plastic sheath which, in turn, protects the structural integrity of the ceramic elements.

The protective means may also be in the form of tubular means rotatably mounted on the structural rod, so that it will rotate when engaged by a saw rather than there being relative movement which would tend to sever the protective means and then the structural rod.

These improved security bars may be mounted on frame means to provide a barrier grid. The bars span the opening of the frame means in space relation to each other. The outer tube of each security bar is secured to the frame means to positively prevent ready access to the core member.

The above and other related objects and features of the invention will be apparent from a reading of the following description, with reference to the accompanying drawings, and the novelty thereof pointed out in the appended claims.

Figure 1:
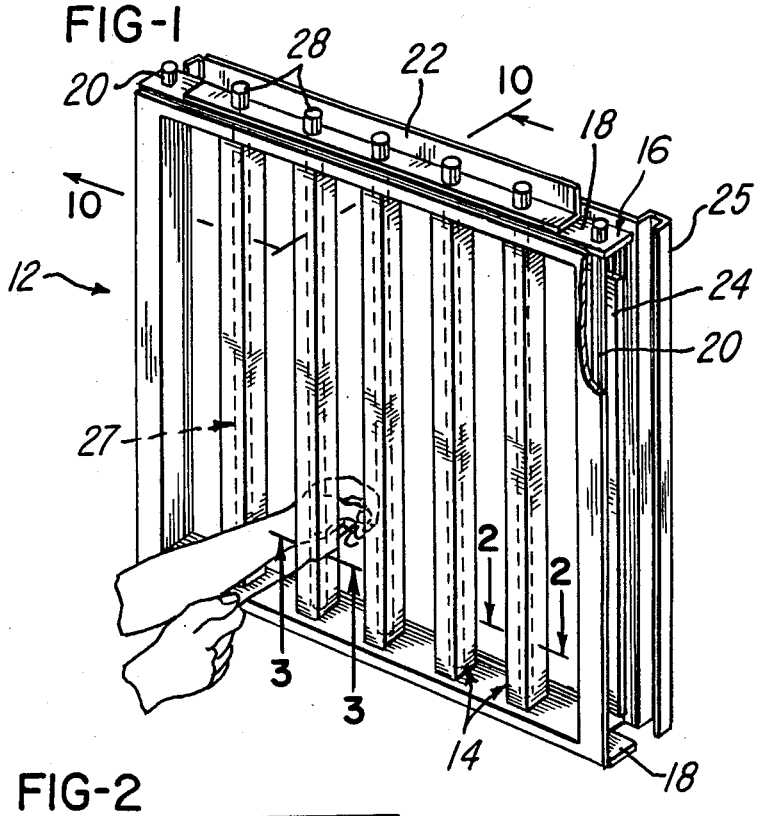
FIG. 1 is a perspective view of a detention window embodying the present invention.
Figure 4:
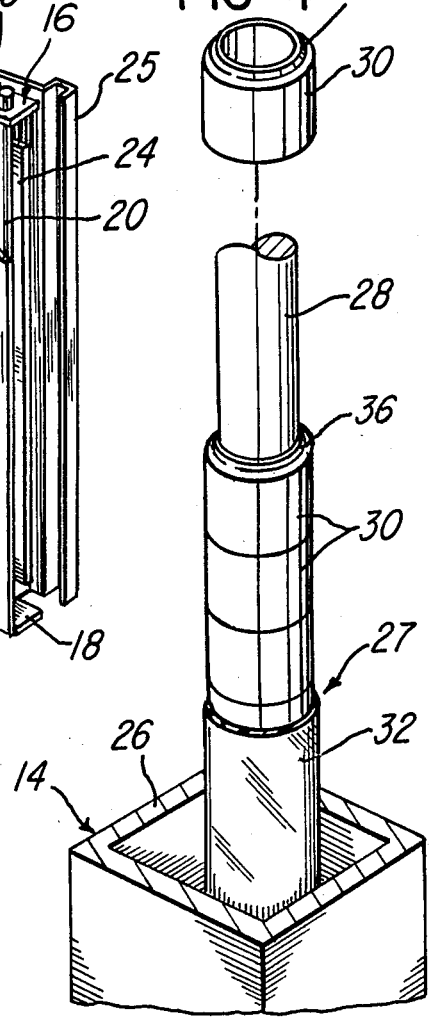
FIG. 4 is a perspective view, with portions broken away and in section, of one of the security bars employed in the detention window of FIG. 1.
Figure 2:
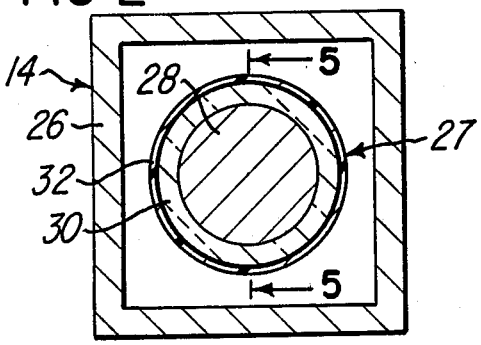
FIG. 2 is a section, on an enlarged scale, taken on line 2—2 in FIG. 1.

FIG. 1 illustrates a detention window, indicated generally by reference character 12, which, in general configuration, is typical of what is presently available for installation in jail cells and the like. It comprises a primary security frame structure 16 formed by top and bottom flat bars 18, connected at their opposite ends by vertical rods 20. A plurality of spaced vertical rods 28 span the frame defined by the bars 18 and rods 20. A secondary frame defines the actual window opening and comprises four relatively thick channel members 25 connected at their ends to define a rectangular opening, within the opening of the primary security structure provided by the bars 18 and rods 20. A plurality of spaced, vertical square tubes are secured at their ends to the top and bottom channel members 25, with the rods 28 extending therethrough, as well as through these channel members.

The described window assembly is mounted in an opening of formed in a wall of a detention facility. Such walls are usually of masonry construction and have embedded members to which the window assembly is secured. The window assembly is provided with angle irons 22 secured to the bars 18 and plates 24 secured to the vertical rods 20, providing flange means which are secured to the fixed, embedded members in the masonry wall.

The security bars of the present invention, designated generally by reference character 14, each comprise a tubular bar 26 and a core member (designated generally by reference character 27) which includes a rod 28, a plurality of ceramic elements 30 and a plastic sheath 32.

The primary security structure including bars 18, rods 20 and particularly the security bar rods 28, are preferable formed of tool resistant steel. As that term is herein used, it is intended to include any alloy, which by reason of metallurgical composition and/or heat treatment is incapable of being cut by conventional metal cutting tools, particularly exemplified by what are known as hack saws. Generally speaking such tool resisting metals would be ferrous based with a 5 carbon content of about 50 to 70 points and heat treated to a hardness in excess of about 60 Rockwell "C".

The ceramic elements 30 are preferably formed of alumina ($Al_2O_3$) or other ceramic or refractory material characterized by a high abrasive capability. The material of the elements 30 has the same characteristics as a man made sharpening stone, comprising alumina particles down to a micron size, bonded in a relatively soft or brittle matrix. These particles have extremely sharp, hard edges, which, when abraded, fracture to expose further sharp edges. These characteristics, as indicated, enable such materials to abrade the hardest of metals, hence their use to sharpen cutting edges of tools.

The sheath 32, in which the elements 30 are encased, is formed of a "plastic" material, with its inner surface bonded to the elements 30 by an adhesive.

Figure 9:
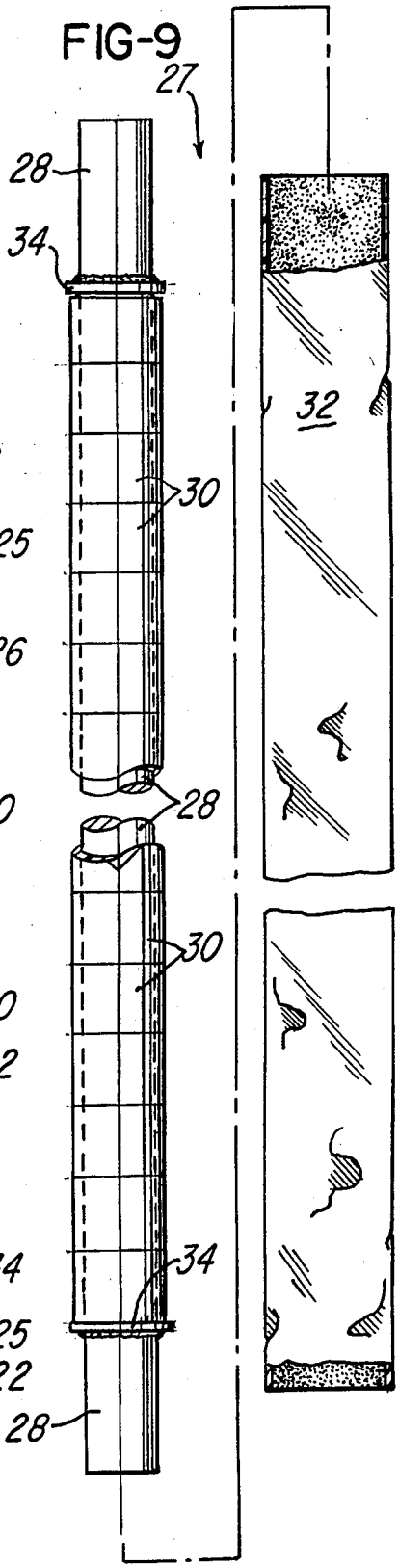
FIG. 9 is an exploded view, partially in section, of the inner portion of the security bar shown in FIGS. 2–6.
Figure 10:
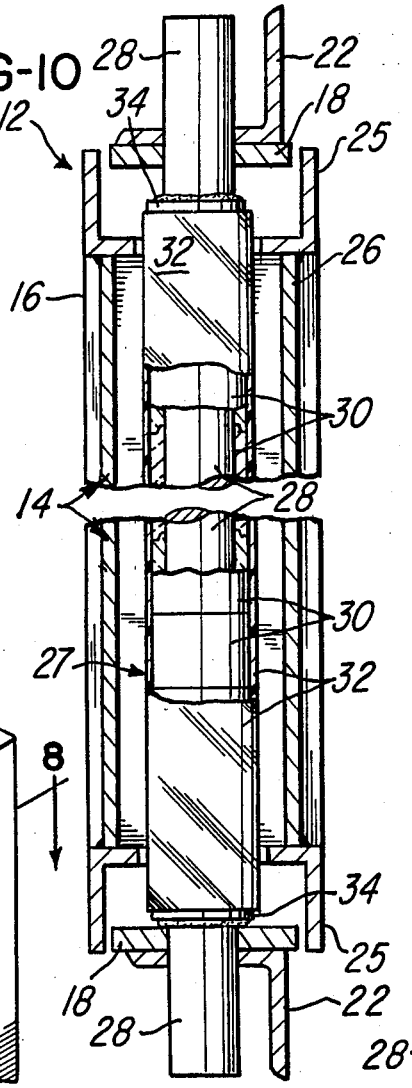
FIG. 10 is a view, on an enlarged scale, taken on line 10—10 in FIG. 1.

FIGS. 9 and 10 illustrate assembly of the security bars 14 and the detention window 12. The core member 27 is first assembled, with the ceramic elements 30 being telescoped over the rod 28 and are axially held in contiguous relation with each other by collars 34 which are spaced from the ends of the rod 28 and welded thereto. The sheath 32 is in the form of a heat shrinkable polyolefin tube, the interior surface of which is coated with a 30 dry adhesive. Such heat shrinkable material is well known, one form being available from the Raychem Corp., Menlo Park, Calif. As indicated in FIG. 9, this tube is telescoped over the assembled length of the protective elements 30. Heat is then applied, in a known fashion to shrink the tube into intimate contact with the elements 30 and at the same time the adhesive is activated to bond the sheath to these elements.

Referencing FIG. 10, the outer tubular members 26, of the security bars 14, are welded to the channel members 25. The core members 27 are inserted through the tubular members 26 and the channel members of frame 25. The bars 18, with the angle irons 22 secured thereto, are then slipped over the end portions of the tool resistant rods 28, and the frame rods 20. The structural frame 16 is then formed by welding the rods 20 to the bars 18. The window assembly may then be completed by welding the channel members 25 to the bars 18. The outer, tubes 26 and the channel members 25 may be economically formed of a relatively soft steel.

The assembled detention window may then be readily installed in an opening in a wall, as previously indicated. In the usual case, a metal frame is embedded in the window opening, with inwardly projecting flanges, or clips, which are engaged by the angle irons 22 and flange bars 24 and welded thereto The described detention window is highly effective in preventing escape through any window opening in which it is installed. The same effectiveness is found when such a grid work is similarly installed to block other openings, such as a ventilating duct.

Figure 3:
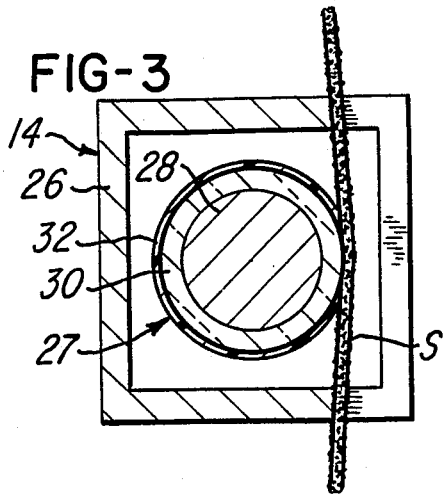
FIG. 3 is a section, on an enlarged scale, taken on line 3—3 in FIG. 1.
Figure 5:
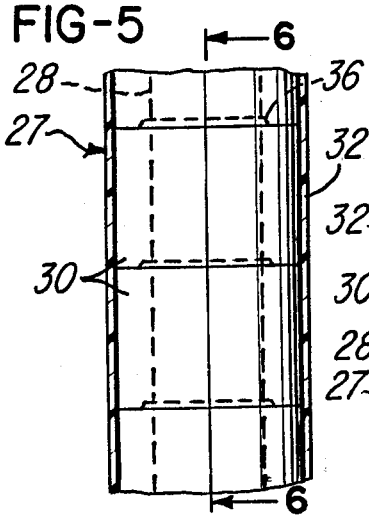
FIG. 5 is a section taken on line 5—5 in FIG. 2.
Figure 6:
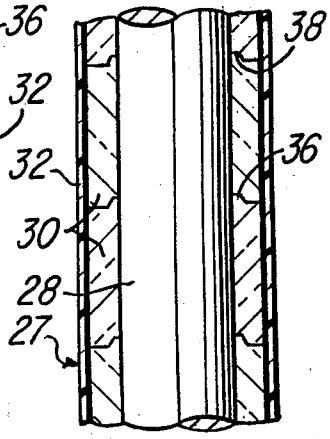
FIG. 6 is a section taken on line 6—6 in FIG. 5.

This may be further appreciated from FIG. 3. The outer tubular members 26 of the bars 14 may be cut by a carbide, wire saw S, with relative ease. These tubes, however, are not the primary security means. Once a tube is partially severed, the saw engages the ceramic element. The hardness of the alumina particles and the abrasive characteristic provided, resists and quickly dulls 30 the carbide elements of the saw, thus preventing the saw from reaching, or cutting, the primary security means provided by the tool resistant rod 28.

The plastic sheath 32 serves the purpose of protecting the structural integrity of the ceramic elements 30. This is to point out that a characteristic of such ceramics is that they are brittle and readily broken by fracturing. The sheath is a deterrent to the possibility of the elements being broken away and thus exposing the core rod 28 to the cutting action of a carbide saw, without the such being dulled by the ceramic. This protective function is enhanced by the tension of the sheath, resulting from its being shrunk in assembly, as well as the adhesive bond employed.

While a single, ceramic protective element could be employed, the use of a plurality of elements 30 is preferred for reasons of economy of manufacture.

It is to be noted that the elements 30 have, at one end, a peripheral rim 36 and, at the other end, a recess 38. The rims 36 nest within the recesses 38 of adjacent elements. Thus, in the event that the saw S should cut through the tube 26 in alignment with the juncture of two elements 30, even should it be possible for the elements to axially separate, the rim 36 would provide a positive abrasive element to dull the saw and preserve the integrity of the rod 28. The tensioned sheath and its adhesive bond also minimizes the possibility of separation of the elements which would permit a saw to be effective in cutting the rod 28.

It is appreciated that, given enough time, and lack of surveillance, it would be possible for the security of this detention window to be defeated. For example, if a large number of saws and considerable time were employed, it would be possible to cut through a ceramic element 30 and, eventually through the rod 28. It is, of course, part of the overall security system to prevent prisoner access to saws and cells are routinely searched for contrband. Also windows and other cell structures, as well as ventilating grids are inspected for saw cuts on a frequent basis. That the present invention solves an existing problem, attests to the fact that this security inspections are not always effective. However, to smuggle a plurality of saws, as opposed to a single saw, makes the likelihood of a successful escape more remote.

Another feature which contributes to the security of the present detention window is found in the difficulty in obtaining relative movement between a saw and the ceramic elements 30 and the rod 28. The rods 28, in accordance with past practices, are rotatable relative to the frame members 18. Further, there is a clearance between the inner diameters of the elements 30 and the rods 28, whereby they may rotate relative thereto. Thus if a saw S engages an element 30, as shown in FIG. 3, when the carbide particles "bite" into the elements, they exert a torque on the element, thereby rotating it relative to the rod 28. The fact that the element 30 is abrasive will tend to abrade any surface imperfections to facilitate such rotation, and tend to further preserve the structural integrity of the rod 28. The feature of relative rotation can also be relied upon as a primary security feature. This is to say, in an alternate embodiment of the invention the protective elements can be formed of a tool resistant steel.

It is also recognized that the ceramic elements 30 can be fractured. The outer tube 26 prevents access to these elements which would enable avoidance of the function of the sheath and enable the ceramic material to be fractured to an 25 extent that the rod 28 would be exposed and capable of being cut. While a section of the tube 26 could be cut away to provide access which permit the elements 30 to be fractured, as well as to hold the core member against rotation, the likelihood of a portion of the tube being cut away, going undetected through visual 30 inspection is remote and the overall security of the detection window thus enhanced.

Figure 7:
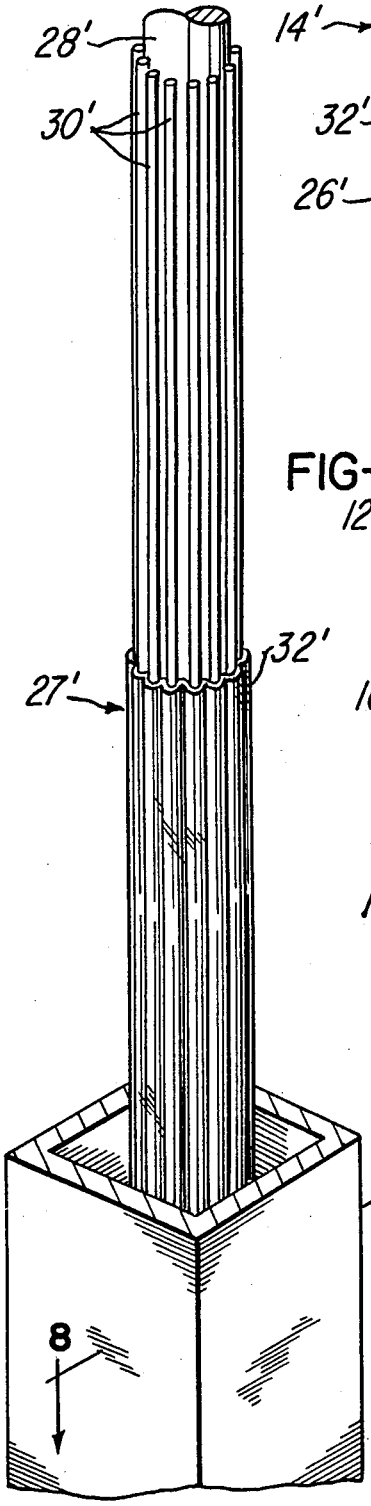
FIG. 7 is a perspective view, with portions broken away and in section, of an alternate embodiment of the security bar.
Figure 8:
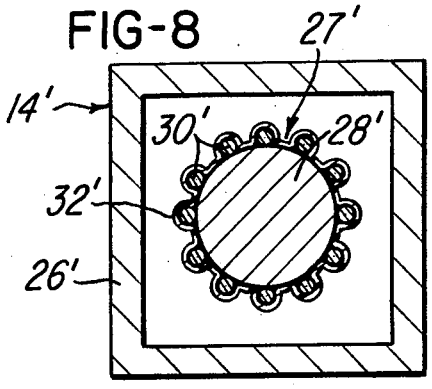
FIG. 8 is a section, taken on line 8—8 in FIG. 7.

FIGS. 7 and 8 illustrate an alternate security bar 14', again comprising an outer tube 26' and a core member 27'. In this embodiment the the ceramic protective elements take the form of elongated ceramic rods 30' spaced around the diameter of a tool resistant rod 28' and held in place by a heat shrunk polyolefin sheath 32'.

This embodiment may be incorporated in a detection window in the same fashion as previously described. The ceramic rods 30' are then effective to resist and dull a carbide saw, in the same fashion as the elements 30.

While the above description has dealt with detention windows as would be used in jail cells, or the like, it will be apparent that the present security bars could be incorporated in other grills, or other security barriers.

From the foregoing it will be apparent that variations from the specific disclosure herein made, will occur to those skilled in the art, within the spirit of the present invention, the scope of which is to be derived from the following claims.

Having thus described the invention, what is claimed as novel and desired to be secured by Letters Patent of the United States is:

1. A barrier grid comprising frame means having a plurality of security bars spanning the frame opening, said security bars each comprising an outer tube and a central, core member, extending lengthwise within said tube, each of said tubes being secured to said frame means and said core members being mounted on said frame means characterized in that the core member includes a structural rod and protective means surrounding said rod, and further characterized in that the protective means comprise an abrasive ceramic material, whereby a saw, which has cut through a tube, will be dulled by engagement with the ceramic material, prior to coming into contact with said structural rod.

2. A barrier grid as in claim 1 wherein the frame means comprise an outer structural frame and an inner frame and the tubes of the security bars are secured to the inner frame and the end portions of the core member rods are mounted on said outer frame and the protective means comprise tubular means mounted on said structural rods.

3. A barrier grid as in claim 2 wherein the tubular means of the protective means are rotatable on said structural rods, and collars, secured to said rods, axially position the

4. A barrier grid as in claim 3 wherein the protective means of each security bar comprise a plurality of ceramic, tubular elements.

5. A barrier grid as in claim 4 wherein the ceramic tubular elements have means preventing access to said structural rod, by a saw, in the event of limited separation of the elements.

6. A barrier grid as in claim 4 wherein each core member further comprises a plastic sheath encasing the ceramic, tubular elements.

7. A barrier grid as in claim 6 wherein the structural rods and the outer frame are formed of tool resistant alloy, the ceramic, tubular elements, each have a recess at one end and a corresponding lip at the other end, and the lip of one element is nested within the recess of an adjacent element to prevent access to said structural rod, by a saw, in the event of limited separation of the elements, and the plastic sheath is adhesively bonded to the ceramic elements.

8. A barrier grid as in claim 1 wherein each protective means comprise tubular means formed of the abrasive ceramic material and rotatable on said structural rods.

9. A barrier grid as in claim 8 wherein each tubular means comprise a plurality of tubular elements.

10. A barrier grid as in claim 9 wherein each protective means further comprises a plastic sheath encasing said ceramic elements.

11. A barrier grid as in claim 1 wherein each protective means comprise a plurality of rods formed of the ceramic material extending lengthwise of the structural rod, said rods being of relatively small cross section and spaced around the periphery of the rod, and a plastic sheath encasing said ceramic rods and tensioned to hold them against said structural rod.

* * * * *